US005339642A

United States Patent [19]

Laukhuf

[11] Patent Number: 5,339,642

[45] Date of Patent: Aug. 23, 1994

[54] REFRIGERANT RECOVERY TO MULTIPLE REFRIGERANT STORAGE CONTAINERS

[75] Inventor: Gregg Laukhuf, Bryan, Ohio

[73] Assignee: SPX Corporation, Muskegon, Mich.

[21] Appl. No.: 29,531

[22] Filed: Mar. 11, 1993

[51] Int. Cl.[5] ..... F25B 45/00

[52] U.S. Cl. ..... 62/77; 62/149; 62/126; 62/292; 141/198

[58] Field of Search ..... 62/149, 292, 77, 126; 141/95, 198

[56] References Cited

U.S. PATENT DOCUMENTS

| | | | |
|---|---|---|---|
| 4,261,178 | 4/1982 | Cain | 62/292 |
| 4,688,388 | 8/1987 | Lower et al. | 62/292 |
| 4,768,347 | 9/1988 | Manz et al. | 62/292 |
| 4,805,416 | 2/1989 | Manz et al. | 62/292 |
| 4,856,289 | 8/1989 | Lofland | 62/292 |
| 4,939,905 | 7/1990 | Manz | 62/292 |
| 4,953,357 | 9/1990 | Van Steenburgh | 62/292 |
| 5,090,211 | 2/1992 | Peters | 62/149 |

*Primary Examiner*—John M. Sollecito

*Attorney, Agent, or Firm*—Barnes, Kisselle, Raisch, Choate, Whittemore & Hulbert

[57] ABSTRACT

A refrigerant recovery system that includes a plurality of refrigerant storage containers, each having a refrigerant inlet port and facility for indicating quantity of refrigerant in the container. A refrigerant recovery unit for withdrawing refrigerant from equipment under service includes an outlet port and internal control for enabling operation of the refrigerant recovery unit to provide a flow of recovered refrigerant at the outlet port withdrawn from the equipment under service. A refrigerant flow control manifold connects the refrigerant recovery unit to the plurality of storage containers. The flow control manifold includes control electronics responsive to indication of refrigerant quantity in the several containers for automatically connecting the outlet port of the recovery unit to each of the plurality of containers as quantity of refrigerant in each container in turn reaches a preselected level. The manifold control is also coupled to the control circuitry of the refrigerant recovery unit, and is responsive to quantity of refrigerant in the several storage containers, for preventing operation of the refrigerant recovery unit when all of the containers are full.

12 Claims, 2 Drawing Sheets

REFRIGERANT RECOVERY TO MULTIPLE REFRIGERANT STORAGE CONTAINERS

The present invention is directed to recovering refrigerant from refrigeration equipment such as air conditioning and heat pump equipment, and more particularly to a system and method for recovering refrigerant to multiple refrigerant storage containers or tanks.

BACKGROUND AND OBJECTS OF THE INVENTION

Many scientists contend that release of refrigerants into the atmosphere deleteriously affects the ozone layer that surrounds and protects the earth from ultraviolet solar radiation. Recent international discussions and treaties, coupled with related regulations and legislation, have renewed interest in devices for recovery and storage of used refrigerant from refrigeration equipment for later purification and reuse, or for proper disposal. U.S. Pat. No. 4,261,178, assigned to the assignee hereof, discloses a refrigerant recovery system in which the inlet of a compressor is coupled through an evaporator and through a manual valve to the refrigeration equipment from which refrigerant is to be recovered. The compressor outlet is connected through a condenser to a refrigerant storage container or tank. The condenser and evaporator are combined in a single assembly through which cooling air is circulated by a fan. Content of the storage container is monitored by a scale upon which the container is mounted for sensing weight of liquid refrigerant in the container, and by a pressure switch coupled to the fluid conduit between the condenser and the container for sensing vapor pressure within the storage container. A full-container condition sensed at the scale or a high-pressure condition sensed at the pressure switch terminates operation of the compressor motor. A vacuum switch is positioned between the inlet valve and the evaporator for sensing evacuation of refrigerant from the refrigeration equipment and automatically terminating operation of the compressor motor.

U.S. Pat. No. 4,768,347, also assigned to the assignee hereof, discloses a refrigerant recovery system that includes a compressor having an inlet coupled through an evaporator and through a solenoid valve to the refrigeration equipment from which refrigerant is to be recovered, and an outlet coupled through a condenser to a refrigerant storage container or tank. An impending tank overfill switch, comprising a tank scale limit switch and/or a tank pressure sensor switch, is connected across utility power to enable operation of the inlet solenoid valve and/or the compressor when the container is not full, and to prevent or terminate application of power when the container becomes full.

Although the systems disclosed in the noted patents address and overcome problems theretofore extant in the art, further improvements remain desirable. For example, it is desirable in many applications to provide for connection of the recovery system to multiple storage containers, which conventionally come in standard sizes such as thirty and fifty pound containers. Desirably, impending overfill of a container would automatically result in the feeding of refrigerant to another container until all containers become full. In this way, the operator may concentrate on refrigerant recovery and equipment repair, without requiring disconnection and replacement of storage containers during a recovery operation. It is a general object of the present invention to provide a refrigerant recovery system and method that satisfies these objectives.

SUMMARY OF THE INVENTION

A refrigerant recovery system in accordance with a presently preferred embodiment of the invention includes a plurality of refrigerant storage containers (i.e., two or more containers), each having a refrigerant inlet port and facility for indicating quantity of refrigerant in the container. A refrigerant recovery unit for withdrawing refrigerant from equipment under service includes an outlet port and internal control for enabling operation of the refrigerant recovery unit to provide a flow of recovered refrigerant at the outlet port withdrawn from the equipment under service. A refrigerant flow control manifold connects the refrigerant recovery unit to the plurality of storage containers. The flow control manifold includes control electronics responsive to the indications of refrigerant quantity in the several containers for automatically connecting the outlet port of the recovery unit to each of the plurality of containers as quantity of refrigerant in each container in turn reaches a preselected level. Preferably, the manifold control is also coupled to the control circuitry of the refrigerant recovery unit, and is responsive to quantity of refrigerant in the several storage containers, for preventing operation of the refrigerant recovery unit when all of the containers are full.

In the preferred embodiment of the invention, the manifold includes a plurality of solenoid valves for individually and selectively connecting the outlet port of the refrigerant recovery unit to an associated one of the storage container inlet ports. A plurality of electronic switches, preferably electromagnetic relays, are each responsive to quantity of refrigerant in an associated container for operating the solenoid valves in a predetermined sequence. The several relays have associated first relay switches that are connected in series to the solenoid valves so that the valves are operated in sequence, and second relay switches that are connected in parallel to the enabling circuitry of the refrigerant recovery unit so that the recovery unit may continue operation as long as any one of the containers can receive additional refrigerant.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
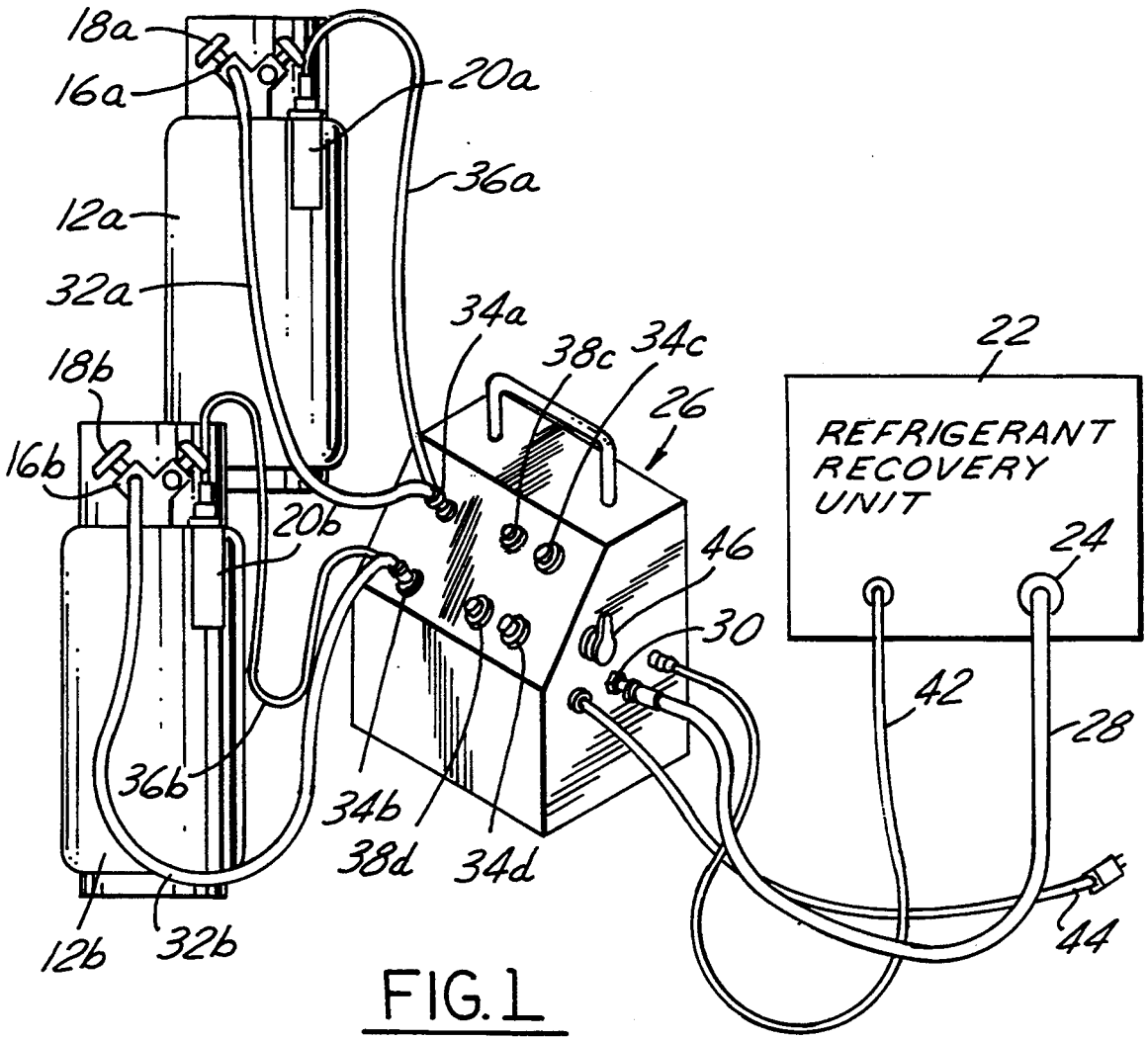
FIG. 1 is a schematic diagram of a refrigerant recovery system in accordance with a presently preferred embodiment of the invention.

FIG. 1 illustrates a refrigerant recovery system 10 in accordance with a presently preferred embodiment of the invention as comprising a plurality of—i.e., two or more—refrigerant storage containers 12*a*, 12*b* each having an associated refrigerant inlet port 16*a*, 16*b* controlled by a manual valve 18*a*, 18*b*. A liquid refrigerant level sensing switch 20*a*, 20*b* is mounted in each associated container 12*a*, 12*b* for providing an electrical signal when level of refrigerant within the container approaches the container top. In one preferred implementation of the invention, switches 20*a*, 20*b* switch from a closed condition to an open condition when level of refrigerant fills eighty percent of the internal container volume. A refrigerant recovery unit 22 is connected to refrigeration equipment under service for providing a flow of recovered refrigerant at a recovery unit outlet port 24. Refrigerant recovery unit 22 may be of any suitable type such as those disclosed in above-noted U.S. Pat. Nos. 4,261,178 and 4,768,347, as well as those disclosed in U.S. Pat. Nos. 4,688,388 and 4,805,416 also assigned to the assignee hereof.

A multiple-container automatic control manifold 26 couples refrigerant recovery unit 22 to the plural containers 12*a*, 12*b*, etc. Specifically, a refrigerant hose 28 connects recovery unit outlet port 24 to an inlet fitting 30 (FIGS. 1 and 2) on the sidewall of manifold 26. A refrigerant transfer conduit 32*a*, 32*b* connects the inlet port 16*a*, 16*b* of each container 12*a*, 12*b* to an associated fitting 34*a*, 34*b* on the front panel of manifold 26. Two additional fittings 34*c*, 34*d* are provided on manifold 26 for connection to two additional storage containers (not shown in FIG. 1). An electrical cable 42 extends from manifold 26 to recovery unit 22 for enabling operation of the latter as long as any of the refrigerant storage containers can receive additional refrigerant. A power cable 44 extends from manifold 26 for providing 120 VAC electrical power to the internal control circuitry to be described in connection with FIG. 3. An electrical two-conductor cable 36*a*, 36*b* connects each container level sensor 20*a*,20*b* to an associated connector on manifold 26. Additional connectors 38*c*, 38*d* are provided adjacent to fittings 34*c*, 34*d* for connection to the level sensors on additional containers (not shown in FIG. 1).

Figure 2:
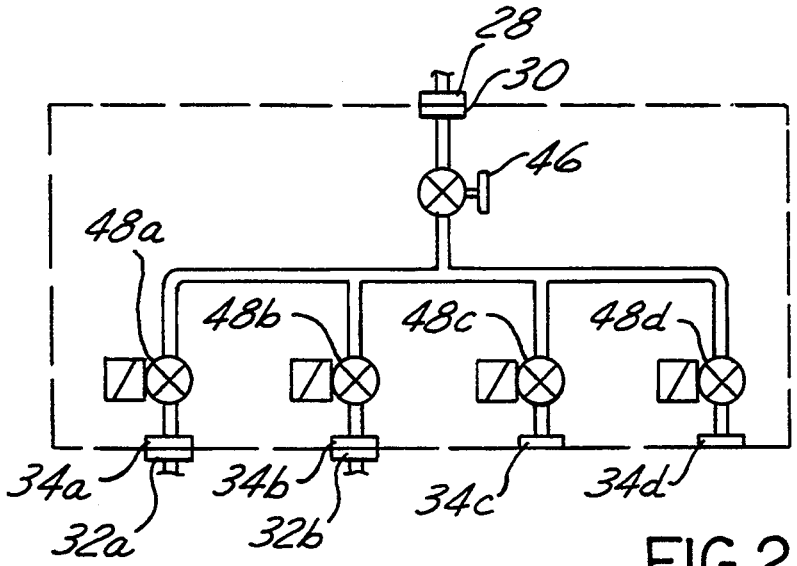
FIG. 2 is a fluid schematic diagram of the multiple-container control manifold illustrated in FIG. 1.
Figure 3:
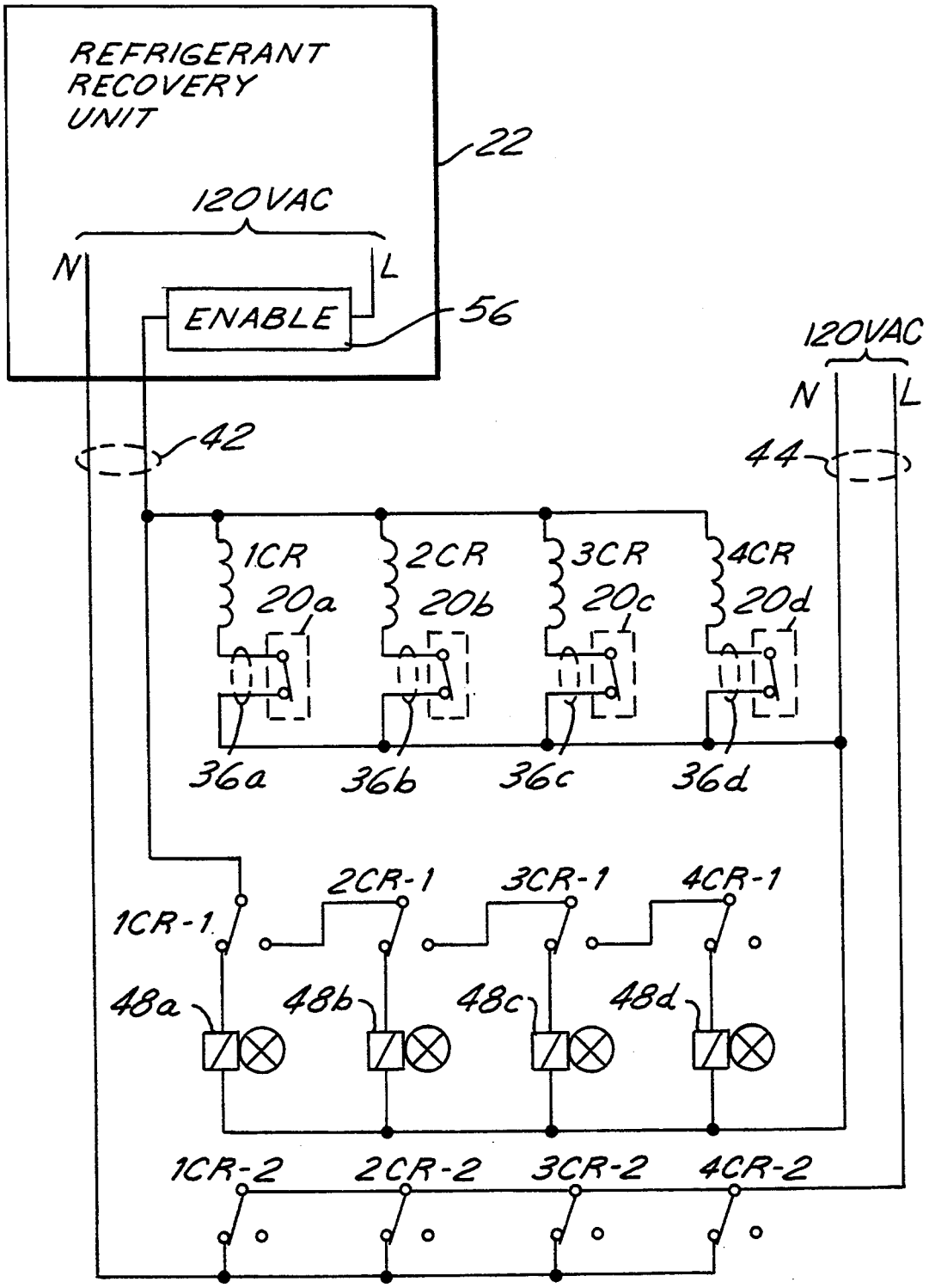
FIG. 3 is an electrical schematic diagram of the multiple-container control manifold.

FIG. 2 illustrates the internal refrigerant plumbing of manifold 26 as including a manual valve 46 (FIGS. 1 and 2) connected to refrigerant inlet port 30, and four solenoid valves 48*a*, 48*b*, 48*c*, 48*d* connected in parallel with each other between manual valve 46 and an associated fitting 34*a*, 34*b*,34*c*, 34*d* on the front panel of manifold 26. FIG. 3 illustrates the electronic control circuitry of manifold 26 as comprising four electromagnetic relays each having an associated relay coil 1CR,2CR,3CR and 4CR. Each relay coil 1CR–4CR is connected in series with an associated container level switch 20*a*, 20*b*, 20*c*, 20*d* through the associated electrical cable 36*a*–36*d*. The several coils 1CR–4CR and series-connected switches 20*a*–20*d* are all connected in parallel between neutral line N of power cable 44, and to power line L of cable 42 through the circuitry 56 (such as a relay) that enables operation of recovery unit 22. Each respective relay coil 1CR–4CR has associated therewith a first relay switch 1CR-4 1 through 4CR-1 and a second relay switch 1CR-2 through 4CR-2. Each relay switch 1CR-1 1 through 4CR-1 has a normally open contact (the relays are illustrated in their energized conditions in FIG. 3) connected through the solenoid of an associated valve 48–54 to neutral line N of power cable 24. The common contact of relay switch 1CR-1 is connected to power line L of cable 42, and the common contact of each successive relay switch 2CR-1, 3CR-1, 4CR-1 is connected to the normally closed contact of the preceding relay switch in sequence. Second relay switches 1CR-2 through 4CR-2 all have common contacts connected to the power line L of power cable 44, and have normally open contacts all connected to the neutral line N of cable 42.

In operation, as previously indicated, container level switches 20*a* –20*d* are normally closed, as shown in FIG. 3, and assume an open condition when the level of refrigerant within the associated container reaches the upper portion of that container. When power is applied to recovery unit 22, and to manifold 26 through cable 44, and assuming all level switches 20*a*–20*d* are closed, all relays 1CR–4CR are energized, and the relay switches assume the conditions illustrated in FIG. 3. Relay switch 1CR-1 applies power to solenoid valve 48*a*, and all of the switches 1CR-2 through 4CR-2 apply power in parallel to enable operation of refrigerant recovery unit 22. Such operation may be enabled by means of the relay switch closure itself as in the relay-based refrigerant control electronics illustrated in above-noted U.S. Pat. No. 4,768,347, or may take the form of microprocessor-based control electronics as disclosed in above-noted U.S. Pat. No. 4,688,388. The disclosures of these two patents are incorporated herein by reference for purposes of background.

With solenoid valve 48*a* so energized, operation of refrigerant recovery unit 22 feeds refrigerant to first storage container 12*a* until the associated refrigerant level switch 20*a* switches from the closed to the open condition. When this occurs, relay coil 1CR is de-energized, and relay switch 1CR-1 switches to the opposite condition to that shown in FIG. 3 so as to apply power to the second solenoid valve 48*b* through relay switch 2CR-1. Second relay switch 1CR-2 also assumes the condition opposite to that illustrated in FIG. 3, but operation of refrigerant recovery unit 22 is still enabled through switches 2CR-2 through 4CR-2 in parallel. Second solenoid valve 48*b* is thus energized, and refrigerant is fed to second storage container 12*b*. This operation continues, with the serial connection of first relay switches 1CR-1 through 4CR-1 functioning to energize the associated solenoid valves in sequence (assuming that the container level switches are closed), while parallel connection of second relay switches 1CR-2 through 4CR-2 continues to enable operation of refrigerant recovery unit 22 until all containers are full. Of course, if only two containers 12*a*, 12*b* are connected to manifold 26 as illustrated in FIG. 1, then the refrigerant level switch connections associated with relays 3CR and 4CR are open, so that these relays cannot be energized, solenoid valves 48*c*,48*d* cannot be opened, and operation of the refrigerant recovery unit cannot be enabled by relay switches 3CR-2, 4CR-2. It will also be noted that refrigerant storage container 12*b* could be connected to port 34*d* and cable 36*b* to connector 38*d*, for example, and operation of the manifold will take place as described by means of relay coils 1CR and 4CR, with relay coils 2CR,3CR being ineffective.

Although the invention has been disclosed in connection with a presently preferred embodiment thereof, it will be recognized that alternatives, modifications and variations may be implemented without departing from the spirit and scope of the invention in its broadest aspects. For example, the relay control circuitry of FIG. 3 can be replaced by microprocessor-based or other suitable solid-state control circuitry. Rather than liquid refrigerant level sensors 20*a*–20*d* associated with the several containers, quantity of refrigerant in each container can be sensed by placing the container on an associated scale and/or connecting a refrigerant pressure switch to an appropriate container port. Use of level sensing switches 20 is preferred because such switches are provided on conventional industry standard refrigerant containers, and thus require no additional parts.

I claim:

1. A refrigerant recovery system that comprises:

a plurality of refrigerant storage means each having refrigerant inlet means and means for indicating quantity of refrigerant in said storage means, refrigerant recovery means for withdrawing refrigerant from refrigeration equipment under service including outlet means and means for enabling operation of said refrigerant recovery means to provide a flow of refrigerant at said outlet means, and a refrigerant flow control manifold including means responsive to said quantity-indicating means at each of said storage means for automatically connecting said output means to each of said plurality of inlet means in turn and in sequence as quantity of refrigerant in each of said storage means in turn reaches a preselected level, said output means being connected to one of said storage means at a time until refrigerant in said one storage means reaches said preselected level and then being automatically connected to the next storage means in said sequence.

2. The system set forth in claim 1 wherein said manifold further includes means coupled to said operation-enabling means and responsive to said quantity-indicating means at said plurality of storage means for preventing operation of said refrigerant recovery means when quantity of refrigerant in all of said storage means reaches said preselected level.

3. The system set forth in claim 1 wherein said manifold includes a plurality of solenoid valve means for individually connecting said outlet means of said recovery means to one of said inlet means on said plurality of storage means.

4. The system set forth in claim 3 wherein said manifold further includes a plurality of electronic switch means each responsive to an associated one of said level-indicating means for operating an associated one of said plurality of solenoid valve means.

5. A refrigerant recovery system that comprises:

a plurality of refrigerant storage means each having refrigerant inlet means and means for indicating quantity of refrigerant in said storage means, refrigerant recovery means for withdrawing refrigerant from refrigeration equipment under service including outlet means and means for enabling operation of said refrigerant recovery means to provide a flow of refrigerant at said outlet means, and a refrigerant flow control manifold including means responsive to said quantity-indicating means at each of said storage means for automatically connecting said output means to each of said plurality of inlet means as quantity of refrigerant in each of said storage means in turn reaches a preselected level, said manifold including a plurality of solenoid valve means for individually connecting said outlet means of said recovery means to one of said inlet means on said plurality of storage means, and a plurality of electronic switch means each responsive to an associated one of said level-indicating means for operating an associated one of said plurality of solenoid valve means.

6. The system set forth in claim 5 wherein said manifold further includes means coupled to said operation-enabling means and responsive to said quanitity-indicating means at said plurality of storage means for preventing operation of said refrigerant recovery means when quantity of refrigerant in all of said storage means reaches said preselected level.

7. The system set forth in claim 6 wherein said first switch means of said plurality of relays are connected in series for energizing said solenoid valve means in sequence.

8. The system set forth in claim 7 wherein said second switch means of said plurality of relays are connected in parallel to said operation-enabling means for enabling operation of said refrigerant recovery means as long as any of said relays is activated.

9. The system set forth in claim 4 wherein said level-indicating means comprises a refrigerant level sensor coupled to each of said storage means.

10. The system set forth in claim 5 wherein said electronic switch means are connected to said solenoid valve means to operate said solenoid valve in a predetermined sequence.

11. The system set forth in claim 5 wherein said plurality of electronic switch means comprises a plurality of relays each having a relay coil coupled to the associated said level-indicating means, a first relay switch coupled to the associated said solenoid valve means and a second relay switch coupled to said operation-enabling means.

12. A method of recovering refrigerant from refrigeration equipment comprising the steps of:

(a) providing a plurality of refrigerant storage containers, (b) generating a plurality of electronic signals indicative of amount of refrigerant in associated ones of said containers, (c) recovering refrigerant from refrigeration equipment, (d) responsive to said electronic signals, feeding recovered refrigerant to each of said containers automatically in sequence until each container is full, and (e) terminating operation of said step (c) when said electronic signals indicate that all of the containers are full of refrigerant.

* * * * *